US005465913A

United States Patent [19]

Naito

[11] Patent Number: 5,465,913

[45] Date of Patent: Nov. 14, 1995

[54] ATOMIZER

[75] Inventor: Tomihisa Naito, Tokyo, Japan

[73] Assignee: Nanomizer, Inc., Tokyo, Japan

[21] Appl. No.: 315,919

[22] Filed: Sep. 30, 1994

[30] Foreign Application Priority Data

Oct. 1, 1993 [JP] Japan ..... 5-246658

[51] Int. Cl.[6] ..... B02C 19/06

[52] U.S. Cl. ..... 241/39; 241/41; 241/34; 241/65

[58] Field of Search ..... 241/1, 15, 39, 241/40, 41, 34, 65

[56] References Cited

U.S. PATENT DOCUMENTS

| | | | |
|---|---|---|---|
| 861,324 | 7/1907 | Sharpneck | 241/39 |
| 3,309,032 | 3/1967 | Filz et al. | 241/1 X |
| 3,467,317 | 9/1969 | Stephanoff | 241/39 X |
| 3,514,043 | 5/1970 | Slepetys | 241/42 X |
| 4,768,721 | 9/1988 | Niemi | 241/39 |
| 4,844,349 | 7/1989 | Kanda et al. | 241/19 |
| 5,363,599 | 11/1994 | Dischler | 451/326 |

*Primary Examiner*—Timothy V. Eley
*Assistant Examiner*—John M. Husar
*Attorney, Agent, or Firm*—Jones & Askew

[57] ABSTRACT

An atomizer for atomizing a material into fine particles thereof, comprising an atomizing unit and a pump for forcibly supplying the material to the atomizing unit. The atomizing unit comprises: a container having an inner space; an inlet for communicating the inner space of the container to the outside thereof; a honeycomb body being provided in the inner space of the container and having a peripheral surface, a plurality of first holes and a second hole, each of the first holes and the second hole being inwardly bored from the peripheral surface to connect with one another at the inside of the honeycomb body; and an outlet tube being connected to the honeycomb body and extending to the outside of the container for communicating the second hole and the outside of the container. The pump supplies the material into the container through the inlet. A plurality of the atomizing units can be connected in series to use. The atomizer is applied to pulverization of a solid material, preparation of an dispersion liquid, an emulsion liquid and break of soft material.

20 Claims, 3 Drawing Sheets

ATOMIZER

BACKGROUND OF THE INVENTION

1. Field of the Invention

The present invention relates to an atomizer for atomizing various materials which are used in the field of ceramic materials, metals, pharmaceutical materials, foods and the like, and, in particular, to an atomizer for breaking a material into ultrafine particles in various modes such as emulsification, dispersion, pulverization, breaking and the like.

2. Description of the Prior Art

It has been known that, when a material is pulverized into ultrafine particles of the 1 micron order or less, or at the nanometer level, the particles of that material tend to exhibit electrically and chemically peculiar properties. Therefore, various mill devices have been developed for breaking a material into ultrafine particles. For such a mill device, an ultrafine pulverizer for use in pulverization of ceramic materials which is difficult to be abraided has been proposed. This mill device is a dry type vertical mill having a pair of rollers. In this mill device, a material to be pulverized is dropped onto a rotating table and scattered in radial directions by means of centrifugal force exerted by the rotating table. The scattered material is then crunched between the rollers and the table. The pulverization operation is controlled and continued until the particle size of the pulverized material reaches to a desired level, while detection of the particle size and separation of the particles are carried out by operating a microcomputer.

However, since the essential part of the conventional mill device described above is also a milling part, a large space, a large scale of facilities and troublesome construction work are required for installing the mill device. Moreover, the mill device itself is expensive due to its high manufacturing cost. In addition, even when the above severe terms are overcome, the throughput capacity of the conventional mill device is low.

SUMMARY OF THE INVENTION

With these problems in mind, therefore, it is the primary object of the present invention to provide a novel atomizer, that is, a cheap atomizer having a large throughput capacity, which includes no milling part and which enables simple installment with a small scale of facilities.

In order to achieve the above-mentioned object, an atomizer for atomizing a material into fine particles thereof, according to the present invention comprises an atomizing unit comprising: a container having an inner space; an inlet for communicating the inner space of the container to the outside thereof; a honeycomb body being provided in the inner space of the container and having a peripheral surface, a plurality of first holes and a second hole, each of the first holes and the second hole being inwardly bored from the peripheral surface to connect with one another at the inside of the honeycomb body; and an outlet tube being connected to the honeycomb body and extending to the outside of the container for communicating the second hole and the outside of the container, and a pump for forcibly supplying the material into the container through the inlet.

Moreover, another atomizer according to the present invention comprises a plurality of atomizing units, each of the atomizing units comprising: a container having an inner space; an inlet for communicating the inner space of the container to the outside thereof; a honeycomb body being provided in the inner space of the container and having a peripheral surface, a plurality of first holes and a second hole, each of the first holes and the second hole being inwardly bored from the peripheral surface to connect with one another at the inside of the honeycomb body; and an outlet tube being connected to the honeycomb body and extending to the outside of the container for communicating the second hole and the outside of the container, a joint connection for connecting the atomizing units in series by joining the outlet tube of the former atomizing unit of every two successive units to the inlet of the latter atomizing units, and a pump for forcibly supplying the material from the inlet of the first atomizing unit of the series into the successive atomizing units.

In addition, an atomizing unit for atomizing a material into fine particles thereof, by forcibly passing the material therethrough, according to the present invention comprises: a container having an inner space; an inlet for communicating the inner space of the container to the outside thereof; a honeycomb body being provided in the inner space of the container and having a peripheral surface, a plurality of first holes and a second hole, each of the first holes and the second hole being inwardly bored from the peripheral surface to connect with one another at the inside of the honeycomb body; and an outlet tube being connected to the honeycomb body and extending to the outside of the container for communicating the second hole and the outside of the container.

In accordance with the above construction, the atomizer is downsized, and the manufacturing cost of the atomizer is reduces. Moreover, it is possible to change the throughput capacity of the atomizer by changing the capacity of the container or by combining a plurality of the atomizing units,

BRIEF DESCRIPTION OF THE DRAWINGS

The features and advantages of the according to the present invention over the proposed will be more clearly understood from the following description of the preferred embodiments of the present invention taken in conjunction with the accompanying drawings in which like reference numerals designate the same or similar elements or sections throughout the figures thereof and in which.

DETAILED DESCRIPTION OF THE PREFERRED EMBODIMENTS

Figure 1:
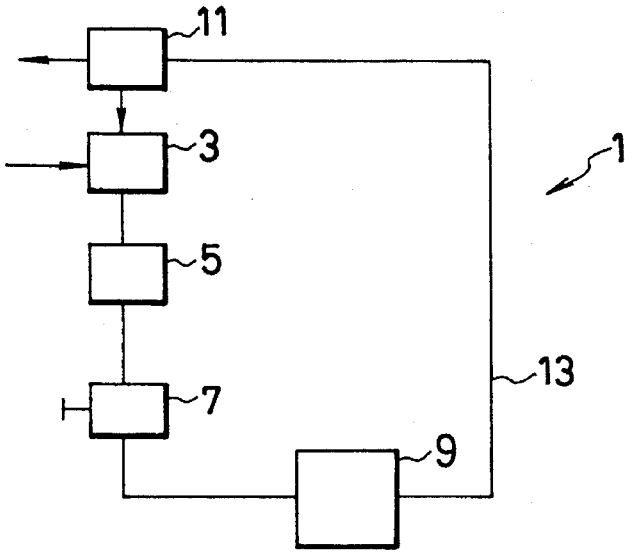
FIG. 1 is a schematic diagram showing a general construction of the atomizer according to the present invention.

Referring now to the drawings, preferred embodiments of the atomizer according to the present invention will be described.

FIG. 1 shows a schematic construction of the atomizer according to the present invention. The atomizer 1 comprises: a receiving unit 3 having an inlet for receiving a material to be atomized; a pumping unit 5 far forwarding the material which is received at the receiving unit 3; an air vent unit 7 for removing air From the material which is forwarded by the pumping unit 5; an atomizing unit 9 which is the essential portion of the present invention; a monitoring unit 11 for monitoring the particle size of the material atomized by the atomizing unit 9; and a connection pipe 13 for connecting these units 3, 5, 7, 9 and 11 so as to make a circle around them.

In operation of the atomizer 1, the material to be atomized is introduced into the receiving unit 3 from the inlet thereof and the pumping unit is operated. The material is pressured by the pumping and fed to the air vent unit 7 unit 5 through the pipe 13. At the air vent unit 7, the air which is contained in the material is removed, and the material is then forwarded to the atomizing unit 9. The material is atomized at the atomizing unit 9, which will be described in detail hereinafter, and then forwarded into the monitoring unit 11. At the monitoring unit 11, the particle size of the atomized material is measured to determine whether the particle size of the material is sufficiently reduced to the desired value. If the measured particle size is still larger than the desired value, the monitoring unit 9 operates to feed back the material to the receiving portion by means of a control valve and the like, and the material is further treated through the atomizing circle described above. If the measured particle size reaches to the aimed level, the material is discharged from the outlet of the monitoring unit to the outside of the atomizer 1.

For the pumping unit 5, a high pressure pump is suitably used, and the pumping performance can be settled to a desired value within a range of 10 to several thousands $kg/cm^2$ according to the kind of a material to be atomized and the objective particle size of the atomized material. It is preferred to use a pump of a less-contamination type or contamination-free type.

Figure 2:
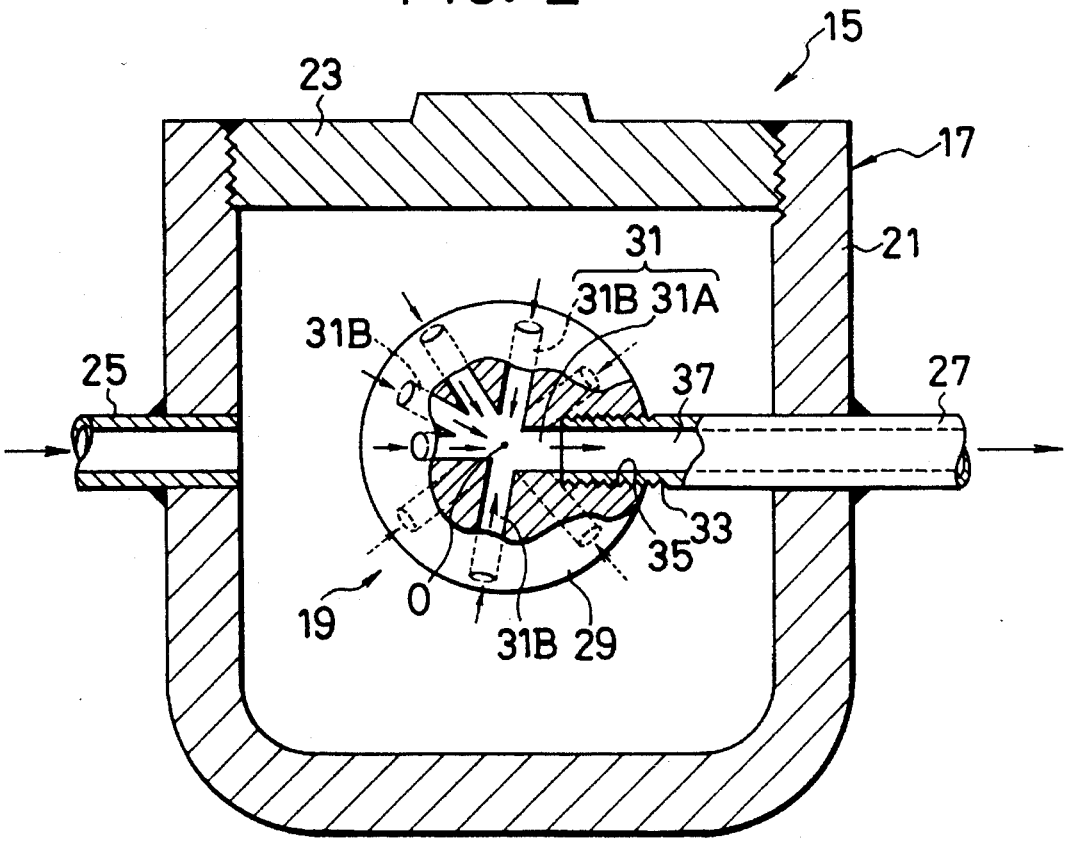
FIG. 2 is a partially sectional view showing a first embodiment of an atomizing unit which is incorporated into the atomizer according to the present invention.

Next, the atomizing unit 9 will be described in detail. FIG. 2 shows a first embodiment of the atomizing unit 9 according to the present invention.

The first embodiment of the atomizing unit 9 comprises a single basic atomizing unit 15. The basic atomizing unit 15 has a container 17 and a honeycomb member 19 which is disposed in the container 17. The container 17 has a cylindrical body 21 with a closed bottom end and an opened top end, and a lid 23 which is screwed down into the opened top end of the container 17 to tightly close the container 17. The container 17 also has an inlet tube 25 for introducing the material to be atomized into the basic atomizing unit 15 and an outlet tube 27 for discharging the treated material from the basic atomizing unit 15. The inlet tube 25 is tightly and fixedly fitted to the left side of the cylindrical body 21 of FIG. 2 by welding, and the outlet tube 27 is fitted to the right side also by means of welding, so as to penetrate the cylindrical body 21 from the opposite sides thereof. Moreover, the outlet tube 27 is protruded into the inner space of the container 17.

The honeycomb member 19 is positioned at the center of the container 17 so that the honeycomb member 19 is surrounded with the inner space of the container 17. The honeycomb member 19 of this embodiment is a spherical body 29 in which a great number of straight cylindrical holes 31 are bored. Each of the holes 31 extends from the periphery of the spherical body 29 to the center 0 thereof in a radial direction, so that all of the boles 31 are concentrated on the center 0 of the spherical body 29 and connected with one another.

The inwardly protruding outlet tube 27 has a male-threaded tip portion 33, and a female-threaded bore 35 which is formed on one hole 31A of the holes 31 of the spherical body 29. The male-threaded tip portion 33 is tightly screwed into the female-threaded bore 35 so that said one hole 31A is smoothly communicated with the inner bore 37 of the outlet tube 27. According to the above structure, the spherical body 29 is fixedly supported by the outlet tube 27 in the container 17.

The container 17 and the honeycomb member 19 are manufactured from a hard material such as metal materials like iron, ceramic materials, or the like, respectively, and machined. Moreover, the inner surface of the container 17 and all of the surface of the honeycomb member 19 are coated with a protective coating such as ceramic materials for imparting abrasion resistance and corrosion resistance to these surfaces.

The inlet tube 25 and the outlet tube 27 are connected to the connection pipe 13 so that the material to be atomized is introduced into and discharged from the basic atomizing unit 15 through the connection pipe 13.

In operation of the atomizer 1, the material to be atomized, being forced by the pumping unit 5, is introduced from the inlet tube 25 into the container 17 to fill the inside space between the container 17 and the honeycomb member 19. Here, It should be noted that, if the material to be atomized is a solid mass, it is preferred to break the material into coarse grains and mix with a liquid carrier prior to the atomizing treatment with the atomizer 1, so as to impart flowability to the material to be atomized.

The material is then rushed into the holes 31, excepting the hole 31A. In the vicinity of the center 0, each portion of the material with the liquid career, flowing through one of the holes 31B, runs against the other portions flowing through other holes 31B and against the bore surfaces of the holes 31. As a result, a coarse grain of the material is crushed into fine particles by the other grains, the liquid carrier and the bore surfaces of the holes 31. As a result, the material is atomized. The atomized material is then pushed into the hole 31A and discharged from the honeycomb member 19 and the container 17 through the outlet tube 27.

As clearly understood from the above description, said one hole 31A in the above construction works as an exhaust passage for the honeycomb member 19, and the other holes 31B work as introduction passages.

In the above-described construction of the basic atomizing unit, the central portion of the honeycomb member 19 where a plurality of thin introduction passages meet together at a single point works like a set of many nozzles which are directed toward a single point and which simultaneously spout out the material, and a portion of the spouted material is hitted on another portion of the material. Namely, the central portion of the honeycomb member 19 serves for the field of atomization by using kinetic energy of the flowing material.

According to the above construction, it is clear from the above description that at least two introduction passage and one discharge passage, or totally at least three holes 31, are necessarily provided for accomplishing the basic atomizing unit according to the present invention.

In the above construction of the basic atomizing unit, high pressure is applied to the holes 31, especially, to the vicinity of the center 0. However, the body 29 of the honeycomb member 19 is dense and integral such that it is substantially the same as unification of nozzles having a large radial thickness. Therefore, the honeycomb member 19 is durable to the pressure. Moreover, the honeycomb member 19 is also pressured from the outside, because it is surrounded by the material which is pressured by the pumping unit 5. As a result, the pressure from the inside of the honeycomb member 19 is balanced with the outside pressure. Therefore, the honeycomb member 19 can bear a rather high pressure.

In this relation, the feature that the honeycomb member 19 is spherical is very important. Of course, it is also possible to use a honeycomb member of another shape. However, use of a spherical body is quite advantageous, because it is the most durable shape against pressure. In detail, the pressuring-force which is exerted by the material being pumped into the container 17 is uniformly loaded to the honeycomb member 19 on the spherical surface thereof, and it is possible to prevent the honeycomb member from being broken under local stress. In other words, for the honeycomb member according to the present invention, it is preferred to apply a shape having high stereoscopic symmetry. For examples of another preferable shape, regular polyhedrons such as a regular dodecahedron, a regular icosahedron, a regular octahedron, a regular hexahedron and the like can be given. However, a spherical body is most suitable. For the similar reason, it is most advantageous to symmetrically dispose the holes 31B on the honeycomb member. Of course. It should be noted that the present invention not be restricted to the above preferred conditions, and the holes 31 may be connected at a point which is slightly apart from the center 0 or slightly non-uniformly disposed.

The material which can be atomized according to the present invention is not limited to only a solid material to be pulverized, but also liquid materials and semisolid materials are applicable. Specifically, a solid or liquid material in the form of a mixture with another material or a medium, e.g., dispersion liquid, emulsion liquid, sol, gel and the like can be given for the material applicable to the atomization. In other words, the present invention also enables to disperse or emulsify a material into a liquid medium by treating mixture of the material and the liquid medium. Therefore, the atomizer according to the present invention can be also used for preparation of a dispersion liquid or an emulsion liquid, break of a soft material and the like. Accordingly, in practical use, the atomizer according to the present invention is widely applicable in the various industrial utilities, in particular, for emulsification of milk, dispersion of lactose, fine grinding and dispersion into a drink of peach or other fruits, break of spirits, dispersion and fine grinding of metals and minerals, emulsification, dispersion and fine grinding of medicines, chemicals and pigments, and the like. In this regard, the capacity of the container 17, the dimension of the honeycomb member 19 and the number and diameter size of the holes 31 are appropriately changed according to the atomized material and the objective degree of atomization. The flowing rate of the material and the pumping pressure are also settled in the similar manner.

When the material to be atomized is changed to another material, it is necessary to clean out the atomizing unit before the next material is supplied. In the present invention, the cleaning operation can be carried out by reversely flowing a washing liquid from the outlet tube 27 to the inlet tube 25. By this work, deposit in the container 17 and holes 31 of the spherical body 29 is washed out. If necessary, the lid 23 is taken off to remove the washing liquid from the container 17. As a result, it is quite easy to return the atomizing unit to the original condition.

Moreover, the present invention is different from the conventional mill device in that kinetic energy of the fluid is used for atomization operation, and that the present invention is thus advantageous in prevention of the pulverized material from contamination.

In the boring work for the holes 31, if a drill is perpendicularly applied to the outer surface of the spherical body 29 to bore the hole 31, and if this work is repeated, the formed holes 31 are naturally connected at the center of the spherical body 29. Therefore, the boring work for holes connected at the center of the spherical body 29 is quite easy. Therefore, the construction of the present invention is advantageous in down sizing of the atomizer and cost reduction in manufacture of the atomizer.

Figure 3:
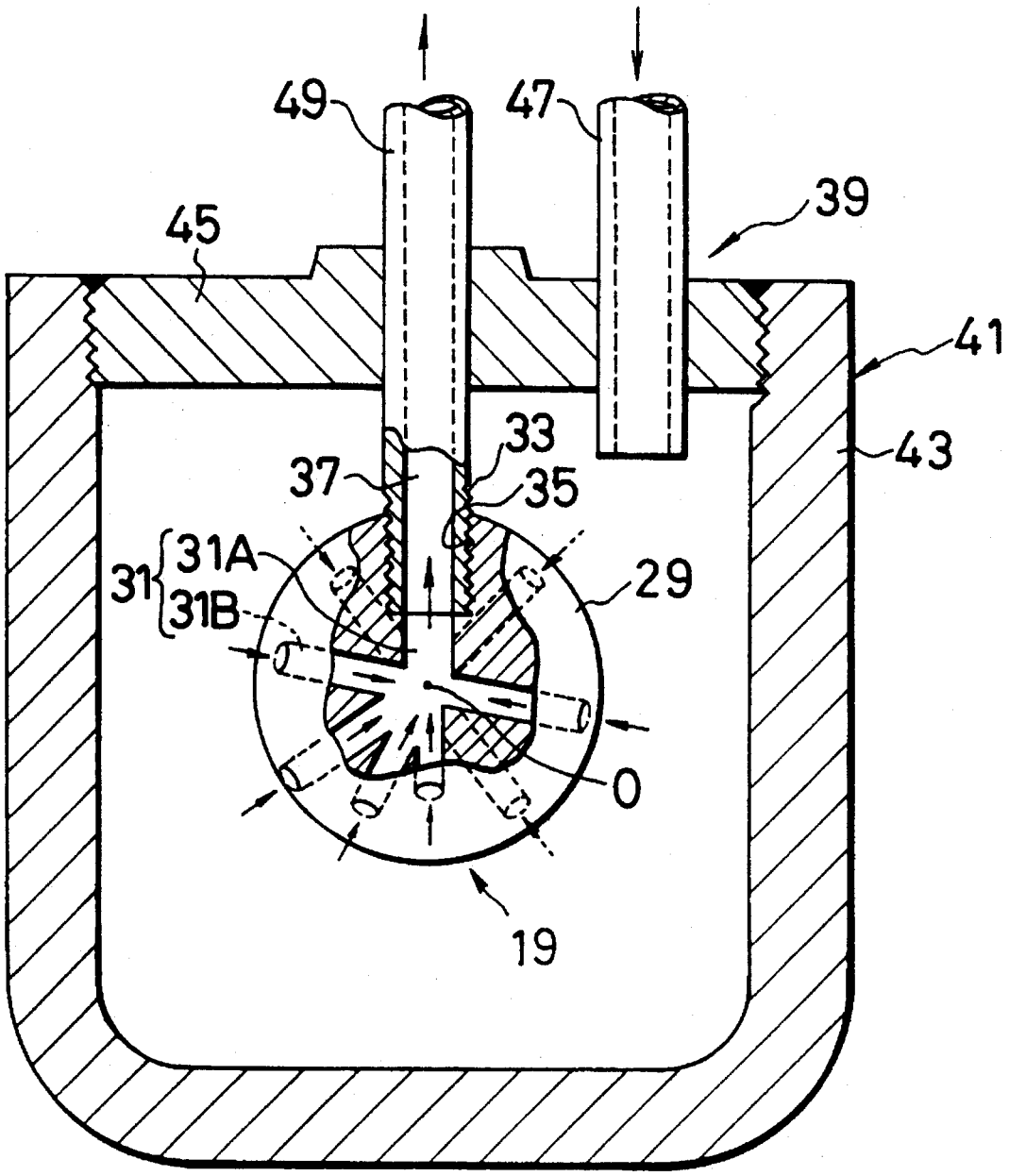
FIG. 3 is a partially sectional view showing a second embodiment of the atomizing unit according to the present invention.

FIG. 3 shows the second embodiment of the atomizing unit 9 comprises another type of a single basic atomizing unit 39. In this embodiment, the container 41 has the same honeycomb member as that of the first embodiment. However, a difference resides in the structure of the container 51 composed of the cylindrical body 43 and the lid 45. Namely, the inlet tube 47 and the outlet tube 49 are fitted to different positions from the first embodiment. Specifically, the inlet tube 47 and the outlet tube 49 penetrate through the lid 45. The outlet tube 49 is screwed into the spherical body 29 in the same manner as the first embodiment.

In the second embodiment of the atomizing unit 9, it is possible to joining the spherical body 29 to the outlet tube 49 on the lid 45 before the spherical body 29 is put into the cylindrical body 29. Therefore, assembling work of the basic atomizing unit 39 is easier. Moreover, the basic atomizing unit 39 of this type can be easily used to modify into a multiple combination thereof, which will be illustrated below as a third embodiment of the atomizing unit 9.

Figure 4:
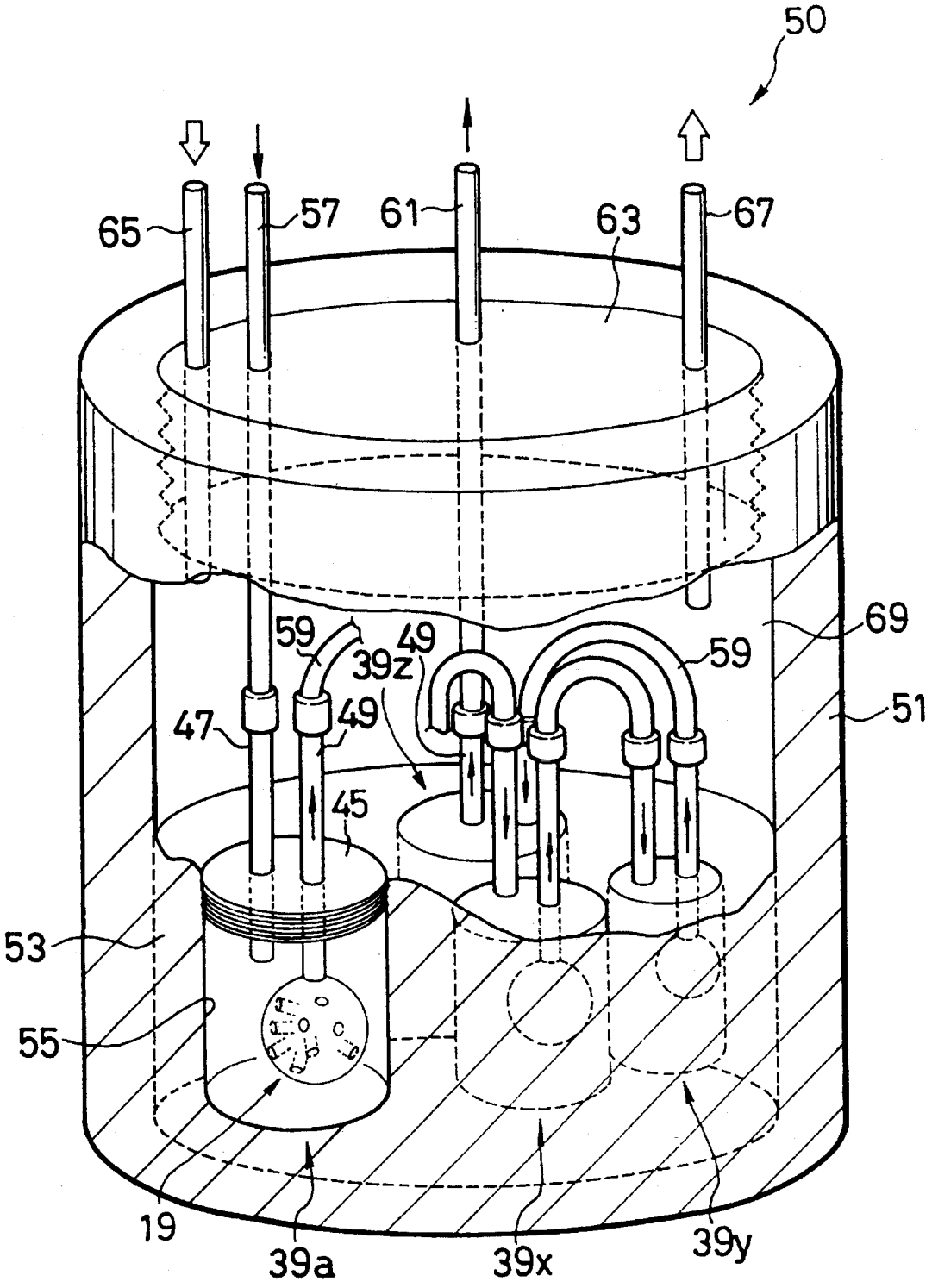
FIG. 4 is a partially cutaway perspective view showing a third embodiment of the atomizing unit according to the present invention.

The third embodiment of the atomizing unit 9 is show in FIG. 4. As shown in the drawing, the third embodiment of the atomizing unit 9 comprises a multiple atomizing assembly 50 into which a plurality of basic atomizing units 39*a*, - - - 39*x*, 39*y*, 39*z* and a thermal control system are incorporated. More specifically, the multiple atomizing assembly 50 has a cylindrical tank 51 with a thick bottom portion 53. For integrally forming the basic atomizing units 39*a*, - - - 39*x*, 39*y*, 39*z*, a plurality of cylindrical bores 55, each of which works as the space in the container 41 of FIG. 3, are formed on the bottom portion 53 so that they are aligned in parallel to the longitudinal axis of the tank 51. In each of the cylindrical bores 55, a lid 45 equipped with a honeycomb member 19, an inlet tube 47 and an outlet tube 49, which are the same as those parts of the second embodiment, is screwed down to construct each of the basic atomizing units 39*a*, - - - 39*x*, 39*y*, 39*z*, respectively. As a result, construction of each of the basic atomizing units 39*a*, - - - 39*x*, 39*y*, 39*z* is substantially the same as that of the second embodiment, as clearly understood from FIGS. 3 and 4.

An input tube 57 for supplying the material to be atomized into the multiple atomizing assembly 50 is connected to the inlet tube 47 protruding from the lid 23 of the first basic atomizing unit 39*a*. Moreover, in every two successive basic atomizing units 39, the outlet tubes 49 of the former basic atomizing unit is a joined to the inlet tube 47 of the latter one with a joint tube 59, for connecting the basic atomizing units 39*a*, - - - 39*x*, 39*y*, 39*z* in series. The outlet tube 49 of the last basic atomizing unit 39*z* is connected to an output tube 61 for recovering the treated material from the multiple atomizing assembly 50. The input tube 57 and the output tube 61 pass through a lid portion 63 of the tank 51.

Moreover, for the purpose of thermal control, the multiple atomizing assembly 50 further comprises a chamber 69 between the 11d portion 63 and the bottom portion 53 of the tank 51, and an input conduit 65 and an output conduit 67 are introduced into the chamber 69 through the lid portion 63 of the tank 51, in order to circulate a fluid through the chamber 69. For the fluid, an ordinary heating medium or a coolant, e.g. water, organic or inorganic liquid medium, etc., can be used. The temperature of the circulated fluid is maintained to a predetermined temperature for controlling the temperature of the material by means of heat transfer which is caused between the fluid and the material flowing In the joint tubes 59.

According to the above construction, the material is supplied from the input tube 57 into the first basic atomizing unit 39*a*. The material flows through the honeycomb member 19 of the first unit 39*a* and it is then atomized in the same manner as described in the first and second embodiments. The material then flows in the joint tube 59, while its temperature is regulated by the fluid in the chamber 69. The atomizing operation is similarly repeated in the subsequent units 39, and the material is finally discharged from the output tube 61.

In the above construction, it is possible to modify the basic atomizing units 39*a*, - - - 39*x*, 39*y*, 39*z* so that the diameter of the holes of the honeycomb member 19 is reduced little by little in accordance with the sequence of the basic atomizing unit 39. By this modification, atomizing efficiency of the multiple atomizing assembly 50 can be improved.

In general, when a material is compressed by high pressure, it generates heat to raise the temperature of itself. In the prevent invention, if an appropriate coolant can be applied to the fluid for thermal control, it is possible to cool the material and maintain the temperature at a constant level. As a result of this, it is possible to present alteration or deterioration of the quality of the material. For another example of utility of the thermal control, flowability control of the material to be treated can be given. If the material to be atomized has high viscosity like a wax or the like, it is difficult to flow the material through the atomizer due to strong resistance caused by low flowability. However, if the viscosity is reduced by heating the material appropriately, flowability of the material is improved so that the atomization operation can be easily carried out by lower pumping energy.

In the first and second embodiments of the basic atomizing unit, it is also possible to place the basic atomizing unit into a vessel which contains a liquid medium for thermal control of the material in the basic atomizing unit in the same manner as the third manner. However, in the first and second embodiments, it is also possible to control the temperature by conditioning the air surrounding the basic atomizing unit.

The atomizing ability of the atomizer according to the present invention is more prominent than that of the conventional mill device. Specifically, the atomizer of the present invention enables break of a solid material such as mineral materials and the like into particles of 0.1 to 0.4 μm. In contrast, the particle size of the same material milled by the conventional mill device is about 0.8 μm. Moreover, the atomizer of the present invention realizes a throughput capacity of 150 kg/hr (or 850 ml/min), in comparison with that of the conventional mill device being about 10 kg/hr (250 ml/min).

It must be understood that the invention is in no way limited to the above embodiments and that many changes may be brought about therein without departing from the scope of the invention as defined by the appended claims.

What is claimed is:

1. An atomizer for atomizing a material into fine particles thereof, comprising an atomizing unit comprising:

a container having an inner space;

an inlet for communicating the inner space of the container to the outside thereof;

a honeycomb body being provided in the inner space of the container at a distance from the container and having a peripheral surface, a plurality of first holes and a second hole, each of the first holes and the second hole being inwardly bored from the peripheral surface to connect with one another at the inside of the honeycomb body; and an outlet tube being connected to the honeycomb body and extending to the outside of the container for communicating the second hole and the outside of the container, and a pump for forcibly supplying the material with a liquid medium into the inner space of the container through the inlet, so that the material is forcibily supplied into the inner space through the inlet and passes through the inner space, the first holes and the second hole of the honeycomb body, and the outlet tube.

2. The atomizer as set forth in claim 1, wherein the honeycomb body has a stereoscopically symmetric shape which is selected from the group consisting of a sphere, a regular dodecahedron, a regular icosahedron, a regular octahedron and a regular hexahedron.

3. The atomizer as set forth in claim 1, wherein the honeycomb body has a substantially spherical shape.

4. The atomizer as set forth in claim 1, wherein the first holes and the second hole are symmetrically disposed in the honeycomb body.

5. The atomizer as set forth in claim 4, wherein each of the first holes and the second hole is bored in a radial direction, and the first holes and the second hole are connected at the center of the honeycomb body.

6. The atomizer as set forth in claim 1, wherein each of the first holes and the second hole has a cylindrical shape.

7. The atomizer as set forth in claim 1, wherein the container has a cylindrical body which is opened at the top and a lid for closing the opened top of the cylindrical body, and the inlet and the outlet tube are formed to pass through the lid.

8. The atomizer as set forth in claim 1, further comprising a thermal controller for controlling the temperature of the material so that the temperature is maintained at a predetermined value.

9. The atomizer as set forth in claim 1, wherein the material to be treated by the atomizer is in the form of coarse solid particles.

10. The atomizer as set forth in claim 1, wherein the material to be treated by the atomizer is in the form of either of dispersion, emulsion, gel, sol or semisolid.

11. The atomizer as set forth in claim 1, further comprising:

a monitor unit for monitoring the particle size of the material treated with the atomizing unit to feed back the material to the atomizing unit when the particle size of the treated material is larger than a desired value.

12. An atomizer for atomizing a material into fine particles thereof, comprising a plurality of atomizing units, each of the atomizing units comprising:

a container having an inner space;

an inlet for communicating the inner space of the container to the outside thereof;

a honeycomb body being provided in the inner space of the container at a distance from the container and having a peripheral surface, a plurality of first holes and a second hole, each of the first holes and the second hole being inwardly bored from the peripheral surface to connect with one another at the inside of the honeycomb body; and an outlet tube being connected to the honeycomb body and extending to the outside of the container for communicating the second hole and the outside of the container, a joint connection for connecting the atomizing units in series by joining the outlet tube of the former atomizing unit of every two successive units to the inlet of the latter atomizing units, and a pump for forcibly supplying the material with a liquid medium from the inlet of the first atomizing unit of the series into the inner spaces of the successive atomizing units, so that the material is forcibly supplied into the inner space through the inlet and passes through the inner space, the first holes and the second hole of the honeycomb body, and the outlet tube of each atomizing unit in succession.

13. The atomizer as set forth in claim 12, further comprising a thermal controller for controlling the temperature of the material so that the temperature is maintained at a predetermined value.

14. The atomizer as set forth in claim 13, wherein the thermal controller is arranged on the joint tube.

15. The atomizer as set forth in claim 12, further comprising a tank with a bottom portion, and the containers of said plurality of the atomizing units are integrally formed on the bottom portion of the tank.

16. The atomizer as set forth in claim 15, wherein each of the inner spaces of the containers has a cylindrical shape which is opened at the top thereof, a lid closes the opened top of each of the cylindrical inner spaces, and the inlet and the outlet tube of each atomizing unit are formed to pass through the lid.

17. The atomizer as set forth in claim 12, wherein the honeycomb body has a substantially spherical shape.

18. The atomizer as set forth in claim 17, wherein each of the first holes and the second hole is bored in a radial direction, and the first holes and the second hole are connected at the center of the honeycomb body.

19. An atomizing unit for atomizing a material into fine particles thereof, by forcibly supplying the material with a liquid medium to pass through the atomizing unit comprising:

a container having a inner space;

an inlet for communicating the inner space of the container to the outside thereof and receiving a supply of the material in the inner space;

a honeycomb body being provided in the inner space of the container at a distance from the container and having a peripheral surface, a plurality of first holes and a second hole, each of the first holes and the second hole being inwardly bored from the peripheral surface to connect with one another at the inside of the honeycomb body; and an outlet tube being connected to the honeycomb body and extending to the outside container for communicating the second hole and the outside of the container, so that the material with the liquid medium is forcibly supplied into the inner space through the inlet and passes through the inner space, the first holes and the second hole of the honeycomb body, and the outlet tube.

20. The atomizing unit as set forth in claim 19, wherein the honeycomb body has a substantially spherical shape, each of the first holes and the second hole is bored in a radial direction, and the first holes and the second hole are connected at the center of the honeycomb body.

* * * * *